United States Patent [19]

Betsudan et al.

[11] 3,995,275

[45] Nov. 30, 1976

[54] REFLECTOR ANTENNA HAVING MAIN AND SUBREFLECTOR OF DIVERSE CURVATURE

[75] Inventors: Shinichi Betsudan; Masanao Iimori, both of Amagasaki; Motoo Mizusawa; Shuji Urasaki, both of Kamakura, all of Japan

[73] Assignee: Mitsubishi Denki Kabushiki Kaisha, Tokyo, Japan

[22] Filed: June 25, 1974

[21] Appl. No.: 482,903

[30] Foreign Application Priority Data

July 12, 1973 Japan ..... 48-78745
July 12, 1973 Japan ..... 48-78746

[52] U.S. Cl. ..... 343/781 CA; 343/837; 343/914

[51] Int. Cl.[2] ..... H01Q 19/18

[58] Field of Search ..... 343/781, 837, 914

[56] References Cited

UNITED STATES PATENTS

| | | | |
|---|---|---|---|
| 2,540,518 | 2/1951 | Gluyas | 343/837 |
| 2,846,680 | 8/1958 | Lewis | 343/837 |
| 3,448,456 | 6/1969 | Pessin | 343/781 |
| 3,518,686 | 6/1970 | Siebecker | 343/781 |
| 3,737,909 | 6/1973 | Bartlett | 343/755 |
| 3,792,480 | 2/1974 | Graham | 343/781 |
| 3,828,352 | 8/1974 | Drabowitch et al. | 343/837 |

*Primary Examiner*—Eli Lieberman
*Attorney, Agent, or Firm*—Oblon, Fisher, Spivak, McClelland & Maier

[57] ABSTRACT

A reflector antenna used for radar, etc, has a subreflector so as to give a relatively large aperture diameter for a primary radiator, and to decrease the effect of the outer atmosphere.

A subreflector having a different curvature in a vertical plane than a curvature in a horizontal plane is provided whereby an antenna having a different beam width in the vertical plane to that in the horizontal plane is provided even though a primary radiator having a rotationally symmetrical beam is employed.

2 Claims, 9 Drawing Figures

FIG. 4A
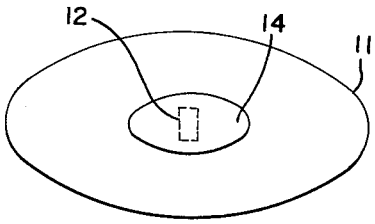
FIG. 4B
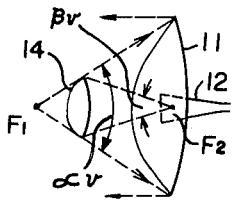
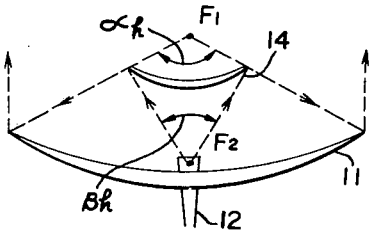
FIG. 4C
FIG. 5B
FIG.5A
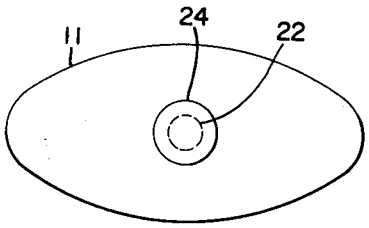
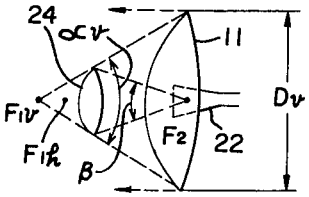
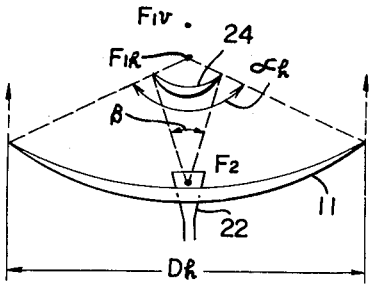
FIG. 5C

REFLECTOR ANTENNA HAVING MAIN AND SUBREFLECTOR OF DIVERSE CURVATURE

BACKGROUND OF THE INVENTION

1. Field of the Invention

The present invention relates to a reflector antenna used for radar, etc. which has improved characteristics by employing a subreflector.

2. Description of the Prior Art

Heretofore, a composite curves reflector antenna having composite curves such as a doubly-curved reflector on the main reflector surface have been known.

As illustrated in FIG. 1, the conventional composite curves reflector antenna generally comprises a main reflector 1 and a primary radiator 2. The aperture of the primary radiator 2 is covered with a dielectric cover 3.

During transmission, the radiation beam radiated from the primary radiator 2 is reflected by the main reflector 1, a shown by the broken line, to radiate in space.

As shown in FIG. 2, the surface of the main reflector 1 of the antenna has composite curves composed of a central sectional curve 1*a* and transverse curves 1*b*.

The central sectional curve 1*a* is selected by the shape of the beam in the vertical plane of the beam.

The curves 1*b* being transverse to the central sectional curve 1*a* are parabolic and have a focus point which is at the phase center F of the primary radiator 2.

In such an antenna, the focal distance to the diameter of the aperture of the main reflector 1 cannot be too long such that a broad beam should be provided from the primary radiator 2.

Accordingly, the primary radiator 2 providing such a beam should have an aperture having a diameter corresponding to substantially 1 – 3 wavelengths. When the primary radiator 2 is used for a high frequency band, such as the millimetric wave band, then the aperture of the primary radiator 2 should be quite small.

Accordingly, under such conditions, when a drop of rain or a piece of snow is deposited on the dielectric cover 3 covering the aperture of the primary radiator 2, the effect is quite high, whereby the conventional reflector antenna can not be operated for the millimetric wave band or higher.

Moreover, in the conventional reflector antenna, the length of the aperture of the main reflector 1 in the vertical plane is different from that of the horizontal plane. Accordingly, the angular aperture of the main reflector in the vertical plane should be different from that of the horizontal plane. Thus, only horns having different diameters in the vertical plane to that in the horizontal plane could be employed as the primary radiator.

The present invention is to overcome the above-mentioned disadvantages.

SUMMARY OF THE INVENTION

Accordingly, it is an object of the present invention to provide a new and improved unique reflector antenna wherein the aperture of a primary radiator is capable of being relatively large in comparison with heretofore such radiators, yet still produce a relatively narrow beam of radiation.

It is a further object of the present invention to provide a new and improved unique reflector antenna having a subflector for enabling a large aperture in a primary radiator.

One other object of the present invention is to provide a new and improved unique reflector antenna whereby high frequency bands can be used with minimal effect due to rain, ice, snow and the like.

Yet one further object of the present invention is to provide a new and improved unique reflector antenna for generating rotationally symmetrical beams.

Briefly, in accordance with the present invention, all the foregoing and other objects are attained by the provision of a reflector antenna comprising a main reflector having a central sectional curve and transverse composite curves of two dimensional curves which is characterized by including a subreflector in the beam path between the primary radiator and the main reflector whereby the beam radiated from the primary radiator is a narrow beam and the aperture of the primary radiator is relatively large. Thus, any effect of deposition of a rain drop or a piece of snow or ice on the primary radiator is reduced, and difficulties in using the millimetric wave band is reduced.

In another embodiment a reflector antenna is provided having a subreflector whose curvature in the vertical plane and in the horizontal plane can be changed so a to generate a beam having a different beam width in the vertical plane to the horizontal plane, even though a rotationally symmetrical beam is radiated from the primary radiator. Accordingly, even though the primary radiator has a rotationally symmetrical beam for circular-polarization use or orthogonal dual-polarization use, the power radiated from the primary radiator can be effectively intercepted by the main reflector.

BRIEF DESCRIPTION OF THE DRAWINGS

A more complete appreciation of the invention and many of the attendant advantages thereof will be readily apparent as the same becomes better understood by reference to the following detailed description when considered in connection with the accompanying drawings wherein:

FIGS. 4*a*, 4*b* and 4*c* are schematic views of another preferred embodiment of the reflector antenna of the present invention wherein FIG. 4*a* is a front, FIG. 4*b* is a side view and FIG. 4*c* is a plan view; and FIGS. 5*a*, 5*b* and 5*c* are schematic views of still another preferred embodiment of the reflector antenna of the present invention wherein FIG. 5*a* is a front view, FIG. 5*b* is a side view and FIG. 5*c* is a plan view.

DESCRIPTION OF THE PREFERRED EMBODIMENTS

Figure 1:
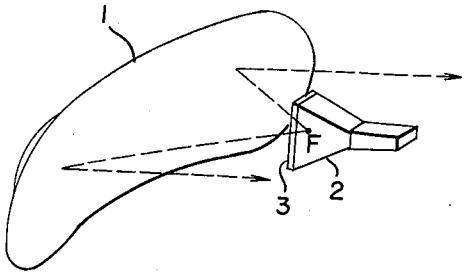
FIG. 1 (PRIOR ART)
FIG. 1 is a schematic view of a conventional reflector antenna.
Figure 2:
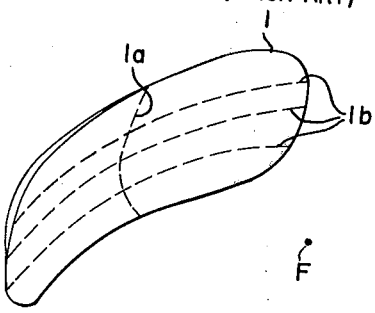
FIG. 2 (PRIOR ART)
FIG. 2 is a geometrical diagram of the conventional reflector antenna of FIG. 1.
Figure 3:
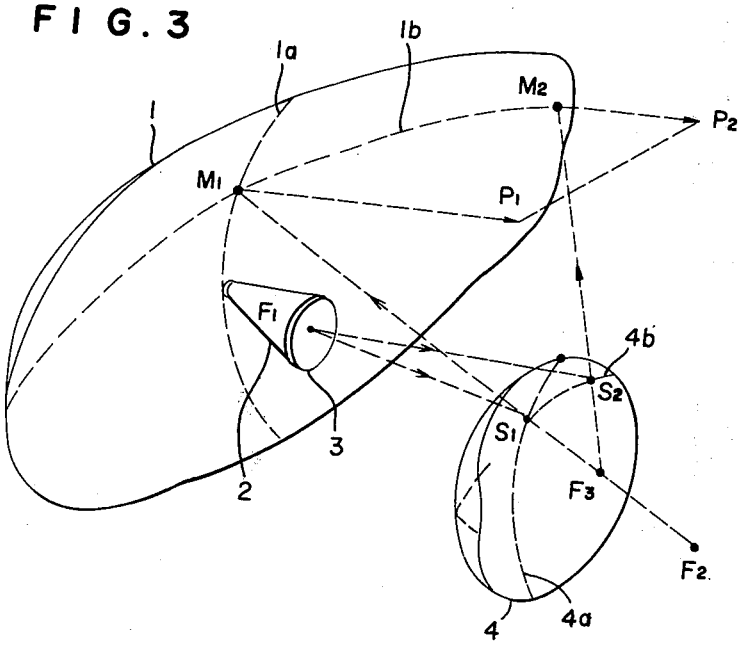
FIG. 3 is a schematic view of one preferred embodiment of the reflector antenna of the present invention.

Referring now to the drawings wherein like reference numerals refer to or designate identical or corresponding parts throughout the several views and more particularly to FIG. 3 thereof wherein is shown one preferred embodiment of the composite curves reflector antenna of the present invention. In FIG. 3 the reference numeral 1 designated a main reflector; 2 designates a primary radiator; 3 designates a dielectric cover and; 4 designates a subreflector. The surface of the main reflector 1 is formed by the central sectional curve 1*a* and the curves 1*b* being transverse to said curve 1*a*. The surface of the subreflector 4 is formed by a central sectional curve 4*a* and a group of curves 4*b* being transverse to the curve 4*a*. The central sectional curve 4*a* of the subreflector 4 is a hyperbola having a focus at $F_2$ and a phase center $F_1$ of the primary radiator 2. The group of curves 4*b* being transverse to the sectional curve 4*a* of the subreflector 4 are hyperbolic and have focuses at $F_1$ and $F_3$.

The focus $F_3$ is on the line $F_2S_1$, and the position of $F_3$ is shifted by the position of $S_1$.

On the other hand, the central sectional curve 1*a* of the main reflector 1 is a special curve to provide beam in the plane comprising the curves and the focus $F_2$, and to reflect the beam transmitted from a point $S_1$ on the central sectional curve 4*a* of the subreflector 4 to a point $M_1$ on the central sectional curve 1*a* of the main reflector 1, to the direction of $M_1P_1$.

The group of curves 1*b* being transverse to the central sectional curve 1*a* of the main reflector 1 are parabolic having a focus $F_3$ and are in the plane $M_1M_2P_2P_1$ transverse to the plane comprising the central sectional curve 1*a*.

In accordance with the reflector system having the composite curves surface, the beam in a discretionary plane generated from the primary radiator 2 such as the beam radiated to $S_1$ and $S_2$ on the subreflector 4 is reflected to $M_1$ and $M_2$ on the main reflector 1 and is reflected from the main reflector 1 to $P_1$ and $P_2$. The beam transmitted from $M_1$ and $M_2$ on the main reflector 1 to space, has the same phase on $P_1P_2$, whereby a narrow beam can be provided in the plane $M_1M_2P_2P_1$. In accordance with the curves system, the angle subtended by the subreflector 4 in the beam of the primary radiator 2 can be discretionarily selected.

Accordingly, with the present invention it should now be understood that the beam generated from the primary radiator 2 can be relatively narrow, and the aperture of the primary radiator 2 can be relatively large, whereby an antenna is provided whose characteristic is not substantially decreased by the deposit of raindrops or pieces of snow on the dielectric cover 3 provided on the front of the aperture of the primary radiator 2.

It should be understood that while in the present embodiment the central sectional curve 4*a* of the subreflector 4 and the curves 4*b* being transverse to the curve 4*a* are hyperbolic; the curves can be various other two dimensional curve such as, for example, an ellipse.

Referring now to FIG. 4, another preferred embodiment of the present invention will be illustrated. In FIGS. 4*a*, 4*b* and 4*c* the primary radiator is a horn having a rectangular aperture. FIG. 4*a* is a front view, FIG. 4*b* is a side view and FIG. 4*c* is a plane view. The reference numeral 11 designates a main reflector having different size aperture in the vertical plane to that of the horizontal plane, and whose surface is paraboloid having a focus $F_1$. The reference numeral 14 designtes a subreflector whose surface is hyperboloid having focusses at $F_1$ and $F_2$; $\alpha_v$ and $\alpha_h$ respectively represent radiation angular apertures of the main reflector 11 in the vertical plane and the horizontal plane of the subreflector 14; and 12 designates the primary radiator having a rectangular aperture radiating a beam having an angle $\alpha_v$ and $\alpha_h$ in the vertical plane and the horizontal plane. The phase center corresponds to the focus $F_2$. In the case of a transmission from the antenna having the above structure, the beam generated from the primary radiator 12 is reflected by the subreflector 14 and the main reflector 11, as shown by the broken line, and is transmitted into space.

In the case of receiving, the beam is transmitted opposite to the above described transmission route. Thus, it should be apparent that it is possible to impart both transmission and reception. The beam generated from the primary radiator 12 can be narrow by selecting suitable curves for the subreflector 14, and the aperture of the primary radiator 12 can be relatively large.

However, in general the horn having a rectangular aperture provides different widths of the beam in excitation by the vertical polarized wave to that of the horizontal polarized wave. Accordingly, it is not generally suitable for dual orthogonally polarized waves and circular polarized waves.

Another preferred embodiment of the present invention is shown in FIGS. 5*a*, 5*b*, and 5*c* for improving the above disadvantages. In FIGS. 5*a*, 5*b* and 5*c*, the reference numeral 11 designates a main reflector; 22 designates a primary radiator; 24 designates a subreflector and FIG. 5*a* is a front view; FIG. 5*b* is a side view and FIG. 5*c* is a plan view.

In the case of transmission, the beam generated from the primary radiator 22 is reflected by the subreflector 24 and the main reflector 11 into space as shown by the broken line.

In order to provide a different beam width in the vertical plane to that of the horizontal plane, the diameter $D_v$ in the vertical plane of the main reflector is made different from the diameter $D_h$ in the horizontal plane.

The beam width of the beam generated from the primary radiator 22 in the vertical plane is equal to that of the horizontal plane. That is, the angle $\beta$ subtended by the subreflector 24 in the vertical plane is equal to that of the horizontal plane.

In order to radiate the beam generated from the primary radiator 22 through the subreflector 24 to the main reflector 11 having a different aperture diameter in the vertical plane to that of the horizontal plane, the beam transmitted to the main reflector 11 in the vertical plane is changed from that of the horizontal plane.

In order to provide the beam having a different beam width, the positions of the focus in the vertical plane and in the horizontal plane are shifted by the main reflector 11 and the subreflector 24. That is, the positions $F_{1v}$ and $F_{1h}$ are shifted as shown in FIG. 5*b*.

In the geometry of the horizontal sectional view of FIG. 5*c* the main reflector 11 is shown by the parabola having the focus $F_{1h}$, and the subreflector 24 is shown by the hyperbola having the focuses $F_{1h}$ and $F_2$.

On the other hand, in the vertical sectional view of FIG. 5*b*, the main reflector 11 is shown by the parabola having the focus $F_{1v}$ and the subreflector 24 is shown by the hyperbola having the focuses $F_{1v}$ and $F_2$.

In the planes between the horizontal plane and the vertical plane, the position of focuses of the main reflector 11 is selected from the range of $F_{1v}$ to $F_{1h}$.

In the horizontal plane and the vertical plane, the focus is shifted between $F_{1v}$ and $F_{1h}$, whereby a rotationally symmetrical beam having a beam width of $\beta$ which is generated from the primary radiator, can be shifted by the subreflector 24 to provide $\alpha_v$ in the vertical plane and $\alpha_h$ in the horizontal plane. Thus, with the present embodiment, the beam is effectively radiated to the main reflector 11 and it is possible to employ a primary radiator generating a rotationally symmetrical beam.

Although the case of transmission was illustrated above, the receiving case should be clearly understood. Moreover, although the case of the subreflector 24 having a hyperbolic sectional view was illustrated, obviously a subreflector having an elliptic sectional view or the like can be used.

As stated above, in accordance with the invention, it should be now apparent that it is possible to employ a primary radiator having a relatively large aperture in the composite curves reflector antenna, whereby a decrease of the characteristic of the antenna caused by deposit of raindrops or pieces of snow on the dielectric cover covering the aperture of the primary radiator, can be advantageously prevented.

In accordance with the present invention, it is possible to employ a primary radiator having a rotationally symmetrical beam and excellent polarization characteristics which can be imparted even though the reflector antenna has a different diameter of the aperture in the vertical plane to that of the horizontal plane.

Obviously, having fully described the invention, it will be apparent to one of ordinary skill in the art that many changes and modifications can be made thereto without departing from the spirit or scope of the invention as set forth herein.

What is claimed and desired to be secured by Letters Patent of the U.S. is:

1. A reflector antenna which comprises:

a primary radiator for generating a rotationally symmetrical beam;

a main reflector having a composite curved surface formed by a central sectional curve determined by the shape of a beam in a vertical plane and a parabola transverse to the curve, said central and parabolic surfaces having spaced focal points;

a subreflector having a composite curved surface formed by a central sectional two dimensional curve and a group of two dimensional curves transverse to the central sectional curve;

wherein the subreflector has a hyperbolic curve having focuse corresponding to a phase center of the primary radiator and to the focus of the parabola transverse to the central sectional curve of the surface of the main reflector.

2. A reflector antenna which comprises:

a primary radiator for generating a rotationally symmetrical beam;

a main reflector having a different aperture diameter in the vertical plane to that of the horizontal plane; and a subreflector having a curved surface to convert a spherical wave to a wave having a different curvature in the vertical plane to that of the horizontal plane to permit the beam to be effectively intercepted by the main reflector;

wherein the main reflector has parabolic curves having a different focus in the vertical plane to that of the horizontal plane, the subreflector has hyperbolic curves having focuses corresponding to a phase center of the primary radiator and to the focus of a vertical parabolic curve of the main reflector in the vertical plane, and the subreflector has hyperbolic curves having focuses corresponding to a phase center of the primary radiator and to the focus of a horizontal parabolic curve of the main reflector in the horizontal plane.

* * * * *